US005168823A

United States Patent [19]

Sheppard, Jr.

[11] Patent Number: 5,168,823

[45] Date of Patent: Dec. 8, 1992

[54] TRANSPORTABLE OFF-SHORE BOAT MOORING AND METHOD FOR USING SAME

[76] Inventor: Edgar M. Sheppard, Jr., 601 E. Moreland Ave., Wyndmoor, Pa. 19118-2521

[21] Appl. No.: 678,135

[22] Filed: Apr. 1, 1991

[51] Int. Cl.[5] ..... B63B 21/00

[52] U.S. Cl. ..... 114/230; 114/293

[58] Field of Search ..... 114/293, 230, 253; 104/173.1

[56] References Cited

U.S. PATENT DOCUMENTS

| | | | |
|---|---|---|---|
| 102,878 | 5/1870 | Street | 441/3 |
| 632,238 | 9/1899 | Christensen | 114/230 |
| 3,049,732 | 8/1962 | Martin | 114/230 |
| 3,055,336 | 9/1962 | Cook | 114/230 |
| 3,062,169 | 11/1962 | Cook | 114/230 |
| 3,063,402 | 11/1962 | Vallquist | 114/230 |
| 3,838,657 | 10/1974 | Fleming | 114/230 |
| 3,971,329 | 7/1976 | Kosmatka | 114/230 |
| 4,353,307 | 10/1982 | Munson | 104/183 |

*Primary Examiner*—Edwin L. Swinehart

*Attorney, Agent, or Firm*—Ferrill, Logan, Johns & Blasko

[57] ABSTRACT

A transportable remote-controlled mooring apparatus and method for water craft is disclosed. The mooring of the present invention employs a relatively large hoop of flexible material through which a water craft activation line travels. The mooring attaches to an anchor or similar secure point off-shore and allows the water craft to be unloaded at shore and then pulled to and retrieved from a safe mooring off-shore. The mooring unit is of minimal size and weight, highly reliable, and not susceptible to fouling problems from waterborne debris.

16 Claims, 1 Drawing Sheet

FIG. 1
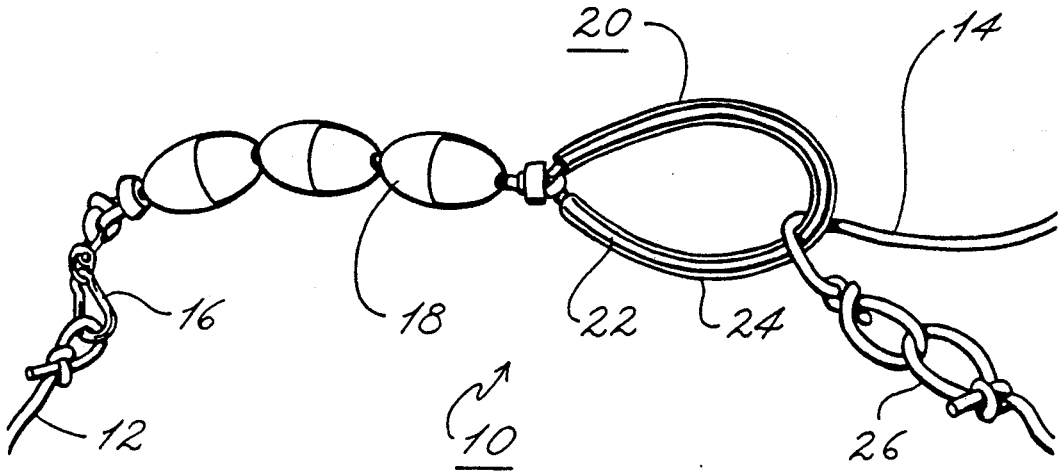
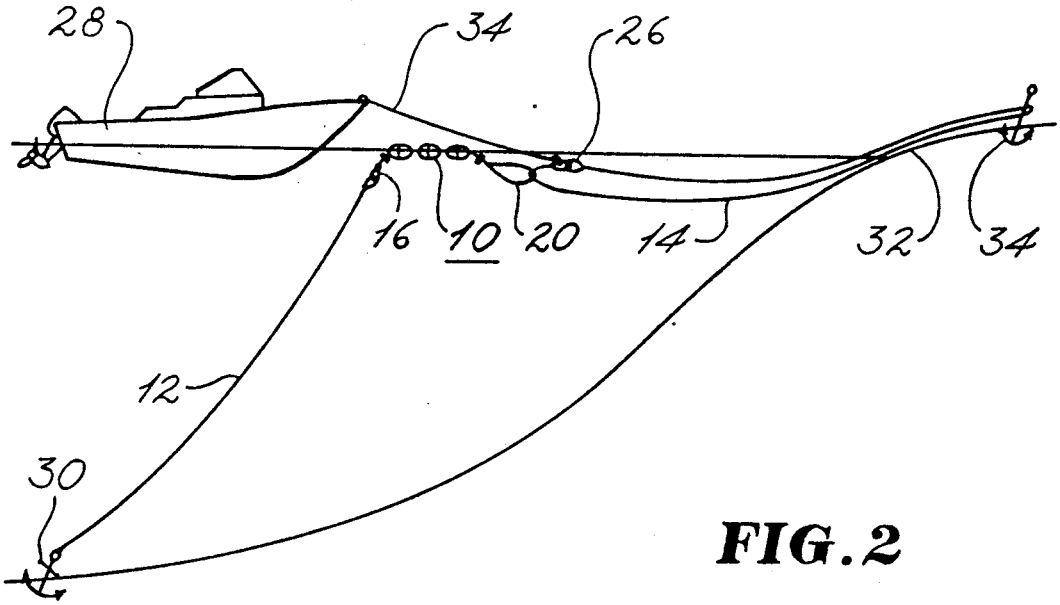
FIG. 2

TRANSPORTABLE OFF-SHORE BOAT MOORING AND METHOD FOR USING SAME

BACKGROUND OF THE INVENTION

1. Field of the Invention

The present invention relates to moorings for boats and other forms of water craft. More particularly, the present invention relates to a transportable device for off-shore mooring of such crafts.

2. Background of the Prior Art

It has long been a recognized problem that boats and other water craft which are navigated to a shoreline are extremely susceptible to damage from the contact of the vessel with the shore. Even with relatively calm water, the movement of the water on the shore can quickly ruin the hull of a boat left at the water line. In order to avoid this problem, small water craft are often pulled out of the water; larger craft are anchored off-shore, with the occupants wading in to the shore or using a smaller boat such as a jitney. With varying tide levels and shifting currents, either of these solutions often requires regular monitoring of the boat and the water line to assure that a temporarily safe position of a boat remains secure.

Although permanent off-shore moorings are known to provide a secure placement for a vessel, these tend to be expensive and are often not available or practical for some shores. Without such a safe off-shore mooring, fishermen, tourists and others who may want to travel to a particular beach for a day are then faced with having to constantly monitor their crafts. Additionally, in colder northern waters, it is often not desirable or practical to attempt to wade in and out from a water craft in order to adjust its position.

In recognition of these problems, a number of solutions have been proposed to provide an off-shore mooring which can be controlled from the shore. U.S. Pat No. 102,878 issued May 10, 1870, to Steel discloses use of a submerged pulley-driven system which uses cables on the shore to pull a craft to and from an off-shore mooring. Other submerged pulley driven systems are disclosed in U.S. Pat. No. 3,063,402 issued Nov. 13, 1962, to Vallquist, U.S. Pat. No. 3,838,657 issued Oct. 1, 1974, to Fleming, and U.S. Pat. No. 3,971,657 issued Jul. 27, 1976, to Kosmatka.

Although these devices may function well for its specific purpose, each are believed to be highly susceptible to serious fouling problems from marine plants and similar debris. In certain areas, the presence of extensive amounts of such debris underwater makes the use of submerged pulleys completely impossible since constant fouling is a certainty. Additionally, a aquatic environment, particularly in salt water, is also known to take a tremendous toll on submerged mechanical parts such as pulleys—leading to on-going maintenance concerns and expenses.

In answer to some of these problems, a number of devices have been developed which attempt to suspend a pulley up out of the water to avoid fouling and lessen maintenance costs. U.S. Pat. No. 632,238 issued Sep. 5, 1899, to Christensen, U.S. Pat. No. 3,049,732 issued Aug. 21, 1962, to Martin, U.S. Pat. No. 3,055,336 issued Sep. 25, 1962 to Cook, and U.S. Pat. No. 3,062,169 issued Nov. 6, 1962, to Cook, all disclose various means to support a pulley and/or boat retrieving line out of the water. Similarly, U. S. Pat. No. 4,353,307 issued Oct. 12, 1982, to Munson discloses means to suspend a pulley out of the water to tow surfers out from the shore.

Although the floating systems may address some of the fouling problems, they are believed to be far too bulky and complex for practical wide-spread use. Moreover, the use of pulleys add to the weight, expense and maintenance of the systems.

Accordingly, it is a primary object of the present invention to provide a reliable apparatus and method for off-shore mooring of water craft which permits an operator to disembark from his or her water craft on shore and then safely moor the craft off-shore with minimal supervision, permitting the craft to be readily retrieved to the shore whenever needed.

It is another object of the present invention to provide such an apparatus and method which operates at or under the surface of the water but will not foul, even in debris-filled waters.

It is an additional object of the present invention to provide such an apparatus which is extremely durable and requires minimal maintenance, making it suitable for all forms of fresh and salt water environments.

It is a further object of the present invention to provide such an apparatus which is of minimal size which can be stored and employed on many forms and sizes of water craft.

It is still another object of the present invention to provide such an apparatus which can be used with conventional anchors to provide a temporary off-shore mooring virtually anywhere a vessel can be anchored off-shore.

It is still a further object of the present invention to provide such an apparatus which can be constructed at minimal expense to allow its wide spread availability.

These and other objects of the present invention will become evident from review of the following specification.

SUMMARY OF THE INVENTION

A transportable off-shore mooring of minimal size and complexity is provided. The mooring permits remote mooring of a boat or other water craft while entailing little risk of fouling from waterborne debris or damage or maintenance problems from a harsh aquatic environment.

In the preferred embodiment, the mooring of the present invention comprises a clasp which attaches to an anchor line off-shore, one or more floats which suspend the mooring near the surface of the water, and a relatively large wear-resistant hoop through which a boat activation line travels. In operation, the water craft's occupants attach the mooring to an anchor or other off-shore fixed point, disembark at the shore or similar location, and attach the craft to the activation line so that it may be pulled away from the shore to a safe location. The activation line is then secured to a fixed point on the shore. To retrieve the craft, the procedure is merely reversed.

The present invention is extremely reliable and can be employed with a wide variety of water craft and under virtually any water conditions. Unlike existing remote mooring units, the mooring of the present invention is not particularly susceptible to fouling from water plants and similar debris. Moreover, the mooring of the present invention is of minimal size and complexity—permitting its easy storage even on small craft, and allowing it to be constructed and maintained at minimal cost.

DESCRIPTION OF THE DRAWINGS

The operation of the present invention should become apparent from the following description when considered in conjunction with the accompanying drawings, in which:

FIG. 1 is a plan view of a mooring of the present invention;

FIG. 2 is a schematic representation of the mooring of the present invention as it is employed between an off-shore anchor line and an activation line to a shore.

DETAILED DESCRIPTION OF THE INVENTION

The present invention provides a transportable off-shore mooring which can be operated from a shore or other remote point to maneuver a boat or other water craft to and from a safe mooring.

As is shown in FIG. 1, the present invention comprises a mooring unit 10 which attaches between an anchor line 12 and a boat activation line 14. In the preferred embodiment shown, the mooring 10 includes: a catch 16 or other means to attach to the anchor line 14; one or more floats 18 or similar devices to suspend the unit 10 at or near the surface of the water; and a hoop 20 through which the activation line 14 travels.

The hoop 20 is preferably a length of flexible material 22 of 24 to 36 inches. It has been found that a ⅜" diameter nylon rope or similar relatively thin material of approximately 32 inches in length, which is tied to itself to form an oblong ring of about 9 inches wide and 12 inches long in diameter, functions quite well for most applications. A 24" length of flexible material will provide a loop of approximately 8". It should be appreciated that the structure and choice of materials for the present invention may be readily modified for particular applications. For example, the size of the mooring 10 and the lines 12, 14 may be easily increased or decreased to handle virtually any size craft.

In order to limit wear on the hoop 20 and to assure smoother operation, the flexible material 22 may be covered with an abrasion resistant material 24 which protects the flexible material 22 from wear. The abrasion resistant material 24 may take any form, including a plastic such as rubber hose material, or a polyvinyl chloride tube. The preferred plastic is a relatively flexible LEXAN® brand plastic tube. It has been found that two LEXAN® tubes (e.g. one with an outside diameter of 1 ¼" and an inside diameter of 1" and another with an outside diameter of 5/16" and an inside diameter of ⅝") can be installed one inside the other to form a strong yet flexible hoop. This material has proven to be extremely durable and it adds to the buoyancy of the entire unit 10. Although not preferred, the hoop 20 may also be constructed from such a plastic material alone.

Threaded through the hoop 20 is the activation line 14. The activation line 14 is a continuous loop of material which is long enough to stretch from a mooring position off-shore to a point of debarkation on shore or at any other suitable place. For most temporary mooring usage of small craft in tidal water, a ⅜" braided nylon activation line 14 of 100 to 200 feet in length, which when tied to itself to form a loop stretches 50 to 100 feet in length, is believed quite suitable. Preferably the activation line is at least 150 feet in length. For still water, the activation line may be as short as 25 feet. Naturally, the size and length of the activation line 14 may be varied as necessary. A coupling 26 to which a water craft may be attached should be provided on the activation line 14, such as a bowline knots (shown), or other knots, or a fitting.

Although not believed necessary for operation of the present invention, floats 18 are provided on the mooring 10 to suspend the mooring at or near the surface of the water. These may be constructed from any conventional material such as styrofoam, styrene, or water-tight sealed plastic. The floats 18 should provide enough buoyancy to keep the mooring afloat even when attached to the anchor line 12 and the activation line 14. It may also be desirable to provide the floats 18 with bright colors to make location of the mooring 10 easier.

The attachment of the mooring to the anchor line 12 is accomplished with the clasp 16. It should be appreciated that this may also be accomplished with any other known means for connecting two lines, including with other forms of hardware or marine fitting on the mooring 10 and/or the anchor line 14, or a knot.

As is shown in FIG. 1, the mooring 10 may be constructed from a single length of rope, with the clasp 16 attached at one end, the floats 18 attached in the middle, and the hoop 20 formed at the opposite end. This is believed to provide a very secure mooring unit 10 while minimizing construction costs.

The operation of the present invention may be understood with reference to FIG. 2. Prior to disembarking from a boat 28 or other water craft, an anchor 30 and anchor line 12 are positioned near to the desired mooring location. The mooring unit 10 is then attached to the end of the anchor line 12 by clasp 16. With the activation line 14 threaded through hoop 20, the boat 28 is navigated to the desired place of debarkation, such as a shore 32, with the activation line 14 being fed out from the boat as necessary. Once the boat 28 is unloaded of its cargo and occupants, a boat line 34 is attached to the activation line 14 using conventional methods, such as coupling 26.

The activation line 14 as a long loop can then be pulled through hoop 20 to cause the boat 28 to be positioned safely off-shore anywhere between the shore 32 and the mooring 10. Once the boat 28 is positioned, the activation line 14 can then be attached to the shore 32 using an anchor 34 or by tying off to a piling, tree, or other structure.

To retrieve the boat 28, the operator need only reverse the procedure to pull the boat back into the shore 32. Upon leaving the shore in the boat, the operator may then leave the mooring 10 and activation line 14 in place for later docking, leave only the mooring in place by disconnecting the activation line, or can pick up the mooring 10 and anchor 30 in their entirety for later use.

The mooring of the present invention functions extremely well in all forms of water and under all forms of water conditions. The large opening of the hoop 20 of the present invention permits even extensive amounts of sea plants and other debris which may become ensnared in the activation line 14 to pass through the hoop 20 without fouling the unit. If some snagging does occur, the size of the hoop 20 permits the mooring to be easily cleared by merely rocking the activation line 14 back and forth. Moreover, so long as a secure activation line is employed, even if the anchor 30, anchor line 12, or mooring 10 fails for any reason, the water craft will merely wash to shore—rather than the craft drifting away as may result from failure of conventional moorings.

It should be appreciated that the present invention lends itself to a wide variety of uses. First, it should be understood that the present invention may be employed with all forms of water craft, including all manner and size of boats, seaplanes, floats, platforms, and other devices. The size of the craft accommodated by the present invention is only limited by the strength of the component parts employed.

Second, in addition to the method outlined above, the anchor 30 may be eliminated by employing the mooring unit 10 with an anchor line 12 attached to existing off-shore moorings or any other similar tie-downs, such as pilings or buoys. Since the precise location of the water craft can be controlled with the present invention, it readily lends itself to attachment to even somewhat unsafe mooring areas (e.g. pier pilings)—with the water craft being positioned in a safe zone between the water hazard and the shore.

Third, although the present invention is intended primarily for use between a mooring and a shore, it should also be understood that the present invention may be used for docking and mooring from any remote location, including from other water craft.

Although particular embodiments of the present invention are disclosed herein, it is not intended to limit the invention to such a disclosure and changes and modifications may be incorporated and embodied within the scope of the following claims.

What is claimed is:

1. In a transportable off-shore mooring for water craft adapted to connect between an anchor line off-shore and a craft activation line passing between the mooring and the shore, the water craft attaching to the activation line for movement between the mooring and the shore, and the activation line comprising a closed loop of material which is threaded through the hoop on the mooring and is of sufficient length to pass between the mooring and an anchor point on the shore, the activation line further including means thereon to attach to the water craft, the improvement which comprises:

the mooring including means to attach to the anchor line, means to suspend the mooring near the surface of the water, and a hoop of flexible material for attachment of the activation line; and the hoop comprising a rope and being of sufficient diameter to permit the activation line to be pulled through it without fouling.

2. The apparatus of claim 1 wherein the rope is covered with an abrasion resistant plastic.

3. The apparatus of claim 1 wherein the rope material is at least 24 inches in length and is attached to itself to form a ring diameter of at least 8 inches.

4. The apparatus of claim 1 wherein the means to attach to the anchor line comprises a clasp affixed to the mooring which is adapted to engage the anchor line.

5. The apparatus of claim 1 wherein the means to suspend the mooring near the surface of the water comprises a float affixed to the mooring.

6. The apparatus of claim 1 wherein the means on the activation line to attach to the water craft comprises a fitting affixed to a specific point on the activation line to which a boat line may be attached.

7. The apparatus of claim 1 wherein the mooring comprises a length of flexible material having the means to attach to the anchor line joined at open end and the hoop joined at the opposite end.

8. The apparatus of claim 7 wherein the hoop is provided with an abrasion resistant covering.

9. The apparatus of claim 8 wherein the means to suspend the mooring near the surface of the water comprises at least one float attached along the length of flexible material.

10. The apparatus of claim 1 wherein the activation line comprises a rope of at least 100 feed in length, which is tied to itself to form a continuous loop.

11. An apparatus for mooring a water craft which comprises:

a mooring having means to attach to an anchor line and a hoop of sufficient diameter to permit a line, including various marine debris which may become attached to the line, to be drawn around it without fouling, the hoop comprising a length of rope forming a ring; and an activation line comprising a closed loop of material which is threaded through the hoop on the mooring and is of sufficient length to pass between the mooring and an anchor point, the activation line further including means thereon to attach to the water craft.

12. The apparatus of claim 11 wherein the mooring includes means to suspend it near the surface of the water.

13. The apparatus of claim 12 wherein the means to suspend the mooring near the surface of the water comprises at least one float attached to the mooring.

14. The apparatus of claim 11 wherein the hoop includes a covering of an abrasion resistant material.

15. The apparatus of claim 11 wherein the rope is at least 24 inches in length and which is attached to itself to form a ring diameter of at least 8 inches.

16. The apparatus of claim 11 wherein the means on the activation line for attachment to the water craft comprises a coupling on the activation line which attaches to a boat line from the water craft.

* * * * *